US011072834B2

(12) United States Patent
Schaefer et al.

(10) Patent No.: US 11,072,834 B2
(45) Date of Patent: Jul. 27, 2021

(54) CONTINUOUS-FLOW COOLING APPARATUS AND METHOD OF COOLING STRIP THEREWITH

(71) Applicant: BWG BERGWERK- UND WALZWERK-MASCHINENBAU GMBH, Duisburg (DE)

(72) Inventors: Dirk Schaefer, Langenfeld (DE); Andreas Noe, Kerken (DE); Thomas Vonderohe, Leverkusen (DE)

(73) Assignee: REDEX S.A., Ferrieres-en-Gatinais (FR)

( * ) Notice: Subject to any disclaimer, the term of this patent is extended or adjusted under 35 U.S.C. 154(b) by 0 days.

(21) Appl. No.: 15/769,540

(22) PCT Filed: Jan. 10, 2017

(86) PCT No.: PCT/EP2017/050401
§ 371 (c)(1),
(2) Date: Apr. 19, 2018

(87) PCT Pub. No.: WO2017/133867
PCT Pub. Date: Aug. 10, 2017

(65) Prior Publication Data

US 2018/0327876 A1 Nov. 15, 2018

(30) Foreign Application Priority Data

Feb. 5, 2016 (DE) ..... 102016102093.1

(51) Int. Cl.
*C21D 1/667* (2006.01)
*C21D 9/63* (2006.01)
(Continued)

(52) U.S. Cl.
CPC ..... *C21D 1/667* (2013.01); *C21D 9/573* (2013.01); *C21D 9/63* (2013.01); *F27D 15/02* (2013.01)

(58) Field of Classification Search
CPC ..... C21D 1/667; C21D 9/573; C21D 9/63; F27D 15/02
(Continued)

(56) References Cited

U.S. PATENT DOCUMENTS 4,401,484 A * 8/1983 Yoshimoto ..... C21D 9/63 148/657
4,407,904 A 10/1983 Uozumi
(Continued)

FOREIGN PATENT DOCUMENTS

DE 1046273 A 4/2002
EP 0949348 A 10/1999
(Continued)

*Primary Examiner* — Scott R Kastler
*Assistant Examiner* — Michael Aboagye
(74) *Attorney, Agent, or Firm* — Andrew Wilford

(57) ABSTRACT

The invention relates to a continuous flow cooling device (3) for cooling a metal strip (1), in particular a metal strip made of aluminum or an aluminum alloy, having at least one strip flotation cooler (4), which has several upper nozzles (5) distributed along the strip travel direction (B), and several lower nozzles (6) distributed along the strip travel direction (B), wherein the metal strip (1) can be transported in a floating manner between the upper nozzles (5) and the lower nozzles (6), and the upper side of the strip as well as the underside of the strip can be supplied with cooling air in the process, and having several water cooling units (7), by means of which the metal strip (1) can be supplied with cooling water. This device is characterized in that the water cooling units (7) are integrated in the strip flotation cooler (4).

9 Claims, 2 Drawing Sheets

(51) Int. Cl.
*C21D 9/573* (2006.01)
*F27D 15/02* (2006.01)

(58) Field of Classification Search
USPC ..... 266/252, 259, 103, 114, 113, 81, 44
See application file for complete search history.

(56) References Cited

U.S. PATENT DOCUMENTS

| | | | | | |
|---|---|---|---|---|---|
| 4,785,985 | A | | 11/1988 | Huertgen | |
| 4,934,445 | A | | 6/1990 | Plata | |
| 5,327,763 | A | * | 7/1994 | Kramer | B21C 29/00 72/201 |
| 5,616,295 | A | * | 4/1997 | Tawara | C21D 11/00 266/92 |
| 5,640,872 | A | | 6/1997 | Plata | |
| 6,054,095 | A | * | 4/2000 | Minato | C21D 1/613 266/81 |
| 6,216,485 | B1 | * | 4/2001 | Kramer | B21C 29/00 62/374 |
| 8,404,062 | B2 | * | 3/2013 | Ueoka | B21B 45/0233 148/636 |
| 10,472,699 | B2 | * | 11/2019 | Baukloh | F27B 9/40 |
| 2011/0266725 | A1 | * | 11/2011 | Mehrain | C21D 9/46 266/44 |
| 2014/0110890 | A1 | | 4/2014 | Noe | |

FOREIGN PATENT DOCUMENTS

| | | | | | |
|---|---|---|---|---|---|
| EP | 1485509 | A | | 5/2008 | |
| GB | 2103251 | A | | 2/1983 | |
| JP | 61253329 | B | | 11/1986 | |
| JP | S61253329 | | * | 11/1986 | C21D 1/667 |
| JP | 62004833 | B | | 1/1987 | |

* cited by examiner

CONTINUOUS-FLOW COOLING APPARATUS AND METHOD OF COOLING STRIP THEREWITH

CROSS REFERENCE TO RELATED APPLICATIONS

This application is the US-national stage of PCT application PCT/EP2017/050401 filed 10 Jan. 2017 and claiming the priority of German patent application 102016102093.1 itself filed 5 Feb. 2016.

FIELD OF THE INVENTION

The invention relates to a continuous-flow cooling apparatus for cooling a metal strip, particularly a metal strip of light metal, for example an aluminum strip.

BACKGROUND OF THE INVENTION

Such an apparatus is typically provided with at least one (first) strip-flotation cooler having a plurality of upper (air) nozzles distributed along the strip-travel direction and a plurality of lower (air) nozzles distributed along the strip-travel direction, with it being possible for the metal strip to be transported in a floating (and hence contact-free) manner between the upper nozzles and the lower nozzles and for cooling air to be applied both to the upper face of the strip and the lower face of the strip, and with a plurality of water coolers that can spray the metal strip with cooling water. The strip-travel direction corresponds to the longitudinal direction of the furnace. It is (substantially) horizontal.

In the context of the invention, "metal strip" preferably refers to a metal strip of a light metal or a light-metal alloy, especially preferably of aluminum or an aluminum alloy. During manufacture, the metal strip is generally heat treated for metallurgic purposes. It is common, for example, for a metal strip that is of an aluminum alloy to be heat treated after cold-rolling in order to optimize the strip characteristics or material characteristics, particularly strength and deformability/plasticity. For instance, increases in strength are commonly achieved in aluminum alloys by precipitation hardening by solution annealing. For this purpose, the metal strip (for example aluminum strip) passes through a furnace, for example a strip-flotation furnace. Depending on the type of alloy, the temperatures during solution annealing of aluminum alloys are usually in a temperature range between 400° C. and 600° C. The alloy elements are dissolved uniformly in the aluminum matrix, creating a homogeneous solid solution. Therefore, the invention relates especially preferably to the treatment of strips of a precipitation-hardenable aluminum alloy, particularly for automotive applications, specifically for the manufacture of automotive panels.

Cooling is necessary following such a heat treatment; this cooling is also referred to as "quenching," since the uniform distribution of the alloy elements is to be "frozen in," as it were.

It is inherently known to do the cooling using air in a conventional strip-flotation cooler. However, since the cooling rates are generally not sufficiently fast for cooling/quenching when air is used, cooling is preferably performed in practice using water ("water quenching"). This enables substantially higher cooling rates to be achieved. The reasoning behind this is that a critical temperature range on the time-temperature curve has to be "bypassed" during quenching. Given this, it has been assumed previously in practice that the cooling should be performed as quickly as possibly by quenching.

One problem with quick cooling, however, is the fact that the strip contracts during cooling, leading to the production of rejects. In practice, this has generally been accepted, since it was common to straighten the metal strip after the heat treatment and after cooling anyway by stretch-bend straightening, for example.

For instance, DE 100 46 273 deals with the problem of contraction during rapid cooling after heat treatment. The deformation of the strip in the strip-travel direction following rapid cooling is reduced by forcible guidance of the strip having a cross-sectional shape similar to a circular arc.

DE 31 29 254 [GB 2,103,251] describes a device for cooling a metal strip having a slot nozzle arranged so as to be inclined relative to the surface and directs a stream of a gas/liquid mixture at the surface.

EP 0 343 103 [U.S. Pat. No. 4,934,445] also describes a method of cooling metal strips by spraying a gas/liquid mixture in the form of a mist onto the surface of the strip.

Similarly, EP 0 695 590 [U.S. Pat. No. 5,640,872] describes a method of cooling hot-rolled plates or also strips of aluminum or aluminum alloys in which, in addition to water nozzles, air nozzles are provided that impose a periodic wiper-like movement on the water jets.

EP 1 485 509 discloses a method of rapid cooling strips or plates of metal in which the water jets are predominantly applied to the lower surface of the strips or plates.

EP 0 949 348 describes a method using a cooling medium in the form of a gas or gas mixture with a boiling point of no more than −150° C. in liquid form, liquid nitrogen for example. Immediately after cooling with liquid gas, the strip or the profile can be further cooled with water or air in a subsequent step.

Finally, it is known in connection with the treatment of extrusion profiles to alternately provide air nozzles on the one hand and water supply nozzles on the other hand in a cooler (see EP 0 942 792 [U.S. Pat. No. 6,216,485] and EP 0 541 630 [U.S. Pat. No. 5,327,763]). The treatment of metal strips, and particularly aluminum strips, during the a continuous pass was not influenced by such considerations.

OBJECT OF THE INVENTION

The object of the invention is to provide a continuous-flow cooling apparatus having a simple construction that can cool metal strips, and particularly strips of aluminum alloys, in an optimal manner and produce outstanding strip characteristics.

SUMMARY OF THE INVENTION

To achieve this object, the invention teaches that, in a generic continuous-flow cooling apparatus of the type described at the outset, the water coolers are integrated into the strip-flotation cooler.

The invention proceeds in this regard from the discovery that, while it is expedient to cool the metal strip (for example aluminum strip) as rapidly as possible in order to optimally "freeze in" the characteristics achieved by the heat treatment, excessively rapid cooling must also be avoided at the same time in order to reduce flaws resulting from contraction of the strip. Even if such flaws can be eliminated in principle in a subsequent straightening process, it was recognized in connection with the invention that, in order to achieve optimal strip characteristics, flaws must be kept to a minimum in order minimize influencing of the strip during a subsequent straightening process. Against this background, cooling is achieved in the context of the invention that does not occur as rapidly as possible, but rather only as rapidly as necessary and simultaneously as slowly as possible in order to preserve the benefits of heat treatment and particularly reduce the formation of precipitation errors. To achieve this, the invention avoids a highly degressive cooling curve (in the time-temperature diagram) that is often observed in practice, opting instead for either a progressive or also a linear cooling curve. The technical equipment used to achieve this is characterized in that combined water/air cooling is implemented by integration of water coolers into a strip-flotation cooler. It is technically quite simple to produce such a device by using the basic construction of a strip-flotation cooler as a point of departure. In such an inherently known strip-flotation cooler, the water coolers can also be of very simple construction and are integrated. In this way, "soft quenching" is achieved while also enabling very good adjustability and hence good possibilities for adaptation to the process and particularly also to the treatment of different strips.

In terms of construction, it is possible as a basic principle to make use of a strip-flotation furnace and cooler having known designs. Such an apparatus has a plurality of upper nozzles that are arranged with spacing along the strip-travel direction such that intermediate spaces are formed between the upper nozzles. Likewise, a plurality of lower nozzles are provided that are arranged at a spacing from one another in the strip-travel direction such that a plurality of intermediate spaces are also formed between the lower nozzles. According to the invention, a plurality of water coolers can now be integrated into the strip-flotation cooler by providing the water coolers in lower intermediate spaces and/or upper intermediate spaces. A plurality of water coolers are thus integrated into the strip-flotation cooler, with at least one water cooler being provided in a plurality of intermediate spaces between lower nozzles (or, alternatively, also upper nozzles) that are each ordered one after the other in the strip-travel direction and thus adjacent one another.

According to the invention, a very compact construction is thus achieved, since the water coolers can be integrated in this way into the strip-flotation cooler such that the intermediate spaces between the nozzles that are present anyway are optimally exploited. Furthermore, excessively rapid cooling of the metal strip can be prevented in this way, since the cooling is performed gradually, as it were, with the aid of the cooling water, and overlaps with cooling by air. This results in optimal adjustment options.

At the same time, faultless stock guidance is ensured, since the plurality of nozzles of the strip-flotation cooler not only serve the purpose of cooling by cooling air, but also faultless stock guidance.

In principle, the air is applied both from above and from below, as is the inherent customary practice in strip-flotation coolers and strip-flotation furnaces. In a preferred embodiment of the invention, however, the water cooling is performed only "from below," that is, in order to apply water only to the lower face of the strip, the water coolers are provided only near the lower nozzles and thus in the lower intermediate spaces beneath the strip. This embodiment offers the advantage that the proper flowing-off of the water is ensured and water pooling on the upper face of the strip can be prevented. In principle, however, it also lies within the scope of the invention to alternatively or additionally apply water to the upper face so that water coolers can also be alternatively or additionally provided in the upper intermediate spaces.

As mentioned above, in designing the strip-flotation cooler, it is possible to make use of constructions that are inherently known using air nozzles. For example, the upper nozzles are spaced in the strip-travel direction so as to be offset relative to the lower nozzles, thereby floating the metal strip in a sinusoidal or wavelike manner. In this case, the water coolers are then arranged so as to be aligned for example opposite the air nozzles when viewed from the side of the furnace. Insofar as the water coolers are thus beneath the strip between the lower air nozzles, the water coolers are positioned so as to be aligned with the opposing (upper) nozzles. Such an embodiment with sinusoidal stock guidance has the advantage that the strip is optimally guided and supported. What is more, an offset arrangement of the upper and lower air nozzles and thus an aligned arrangement of the upper nozzles relative to the water coolers offers the advantage that the application of air prevents the water that is projected from below from getting over the edges of the strip onto the surface thereof.

Alternatively, however, it also lies within the scope of the invention for the upper nozzles to be aligned in pairs one over the other when seen from the side, so that the strip is not caused to float in a sinusoidal manner. In such an embodiment, it can be optionally advantageous to provide, in addition to the aligned upper nozzles, additional air nozzles between these that, in turn, are offset with respect to the lower air nozzles and thus aligned with the water coolers. With basically sinusoidal stock guidance, the additional application of air above the water coolers also prevents water from traveling from below over the edges of the strips and onto the upper face thereof.

The water coolers themselves can be constructed and set up in an inherently known manner. They can each have one or more water nozzles and/or rows of water nozzles that are spaced apart in the strip-travel direction and extend transverse to the strip-travel direction over the full width of the strip.

Even though the combination of water nozzles and air nozzles within a strip-flotation cooler is the focus of the invention, it also lies within the scope of the invention to optionally provide at least one water cooler upstream of the strip-flotation cooler. It is thus possible for the metal strip, after having undergone a heat treatment and emerged for example from the strip-flotation furnace, to first pass through a conventional water cooler and thus conventional water quenching and only then enter the strip-flotation cooler according to the invention with integrated water coolers. In this way, the system as a whole can be operated in a highly variable manner. For instance, it is possible to cool the metal strip very quickly after the heat treatment in a conventional manner with the aid of water cooling. Alternatively, however, the optionally provided water cooling can also be switched off, so that the "soft quenching" according to the invention is then used within combined water/air cooling.

The invention also relates to a method of cooling a metal strip, particularly an aluminum strip, in a continuous-flow cooling apparatus of the above-described type. The metal strip passes through the strip-flotation cooler under tension in the (substantially horizontal) strip-travel direction that corresponds to the longitudinal direction of the furnace. This ensures continuous treatment during a continuous pass. The metal strip is transported in a floating and thus contact-free manner between the upper nozzles and the lower nozzles, and cooling air is applied both to the upper face of the strip and to the lower face of the strip. Cooling water is applied to the metal strip as well. According to the invention, cooling water is applied to the metal strip within the strip-flotation cooler by a plurality of water coolers that are integrated into the strip-flotation cooler.

In a preferred embodiment, water is applied to the metal strip within the strip-flotation cooler with water coolers that are provided in a plurality of intermediate spaces between two respective upper nozzles or lower nozzles in immediate succession (and thus adjacent one another) in the strip-travel direction. According to the invention, optimal cooling rates can be set that achieve relatively rapid cooling in order to "freeze in" the characteristics of the strip achieved by a heat treatment. On the other hand, excessively rapid cooling is avoided in order to minimize flaws that can arise during contraction of the strip during cooling. Preferably, the invention proposes that the metal strip be cooled between two adjacent lower nozzles or upper nozzles by the water cooler provided in the respective intermediate space by a temperature difference of no more than 100° K, for example no more than 75 K, preferably no more than 50° K.

The object of the invention is also a system for heat treating a metal strip, particularly of an aluminum strip, with at least one treatment device, for example a furnace, particularly a strip-flotation furnace, and with at least one continuous-flow cooling apparatus of the described type. The continuous-flow cooling apparatus according to the invention is downstream of the treatment furnace intended for heat treatment in the working direction and hence the strip-travel direction. The continuous-flow cooling apparatus according to the invention is thus also protected in combination with a strip-flotation furnace and thus within a system for heat treatment. At the same time, it is expedient for an additional strip-flotation cooler to be provided downstream of the described continuous-flow cooling apparatus that works with air cooling on the one hand and with water cooling on the other, but the strip-flotation cooler is preferably embodied without water cooling and thus with a conventional design. As described, the treatment device to which the continuous-flow cooling apparatus is connected can be a treatment furnace for heating the strip. However, the invention also includes the combination of the continuous-flow cooling apparatus with other treatment devices. For instance, the continuous-flow cooling apparatus according to the invention can also be downstream of a (hot) roller mill or a (hot) roll stand or even another treatment station through which the metal strip passes or in which the metal strip is heated.

Finally, the invention also relates to a method of heat treating a metal strip in a system of the described type. This method is characterized in that the metal strip is first heated in the treatment furnace and subsequently cooled in the continuous-flow cooling apparatus and, optionally, an additional strip-flotation cooler. In terms of the method as well, it is possible for the metal strip to not pass through a treatment furnace, but rather through another treatment device, for example a roller mill/roll stand or the like.

BRIEF DESCRIPTION OF THE DRAWING

The invention is explained in further detail below with reference to a schematic drawing that illustrates only one embodiment.

SPECIFIC DESCRIPTION OF THE INVENTION

Figure 1:
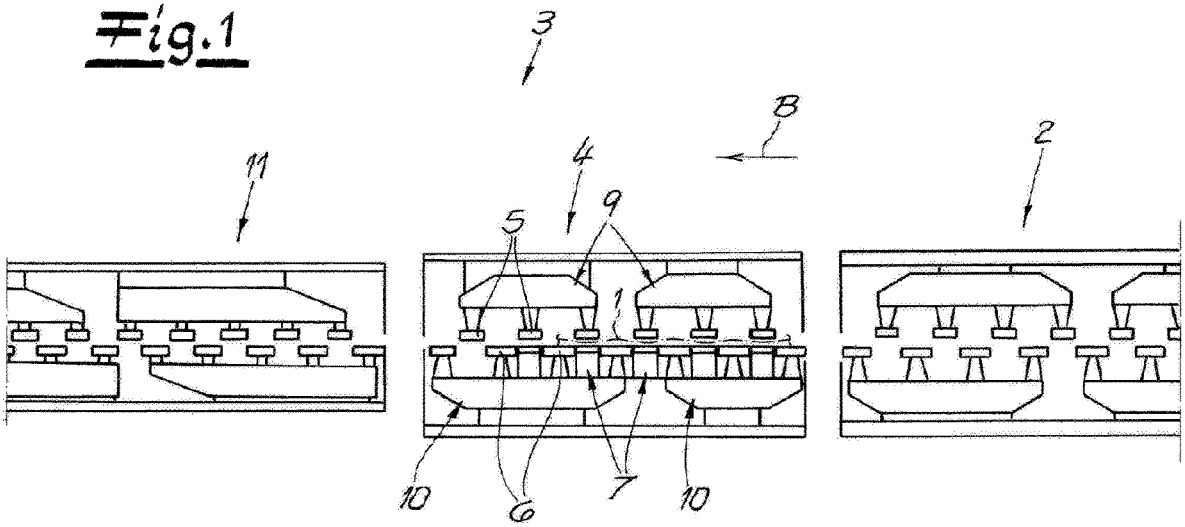
FIG. 1 shows a system according to the invention for heat treating an aluminum strip with a continuous-flow cooling apparatus according to the invention.

The drawing shows a system for heat treating a metal strip 1 that is preferably an aluminum strip. The system has a treatment furnace 2 that is a strip-flotation furnace and in which the metal strip is heat treated. This can involve solution annealing or the like.

Furthermore, the system has a continuous-flow cooling apparatus 3 that is downstream of the strip-flotation furnace 2 in a strip-travel direction B. The continuous-flow cooling apparatus 3 according to the invention has a strip-flotation cooler 4 having a plurality of upper air nozzles 5 distributed along the strip-travel direction and a plurality of lower air nozzles 6 also distributed along the strip-travel direction, with the metal strip 1 being transported in a floating and hence contact-free manner between the upper nozzles 5 and the lower nozzles 6. Cooling air is applied both to the upper face of the strip and to the lower face of the strip through the air nozzles 5 and 6. Moreover, the continuous-flow cooling apparatus 3 has a plurality of water coolers 7 with which water is applied to the metal strip 1.

According to the invention, these water coolers 7 are integrated into the strip-flotation cooler 4. Upper intermediate spaces 5*a* and lower intermediate spaces 6*a* are formed within the strip-flotation cooler 4 between the individual upper air nozzles 5 and the individual lower air nozzles 6, and these intermediate spaces 5*a* and 6*a* are each provided between two upper nozzles 5 or two lower nozzles 6 arrayed in immediate succession in the strip-travel direction B and thus adjacent one another. In the illustrated embodiment, a water cooler 7 is provided in a plurality of lower intermediate spaces 6*a* and preferably in all intermediate spaces 6*a* that are formed within the strip-flotation cooler 4. Each of these water coolers 7 has one or more water nozzles and/or rows of water nozzles 8 that are arranged successively in the strip-travel direction B and extend transverse to the strip-travel direction B across the entire width of the strip.

In this embodiment, the strip-flotation cooler has a plurality of upper nozzle boxes 9 each having a plurality of integrated upper nozzles 5, and a plurality of lower nozzle boxes 10 each having a plurality of integrated lower nozzles 6. The water coolers provided according to the invention are thus in the vicinity of the lower nozzle boxes 10, particularly between the individual lower nozzles of each nozzle box and also between two succeeding lower nozzle boxes 10.

The possibility exists for the upper nozzle boxes 9 and/or the lower nozzle boxes 10 to be hung so that their vertical position can be adjusted such that, by adjusting the vertical position of one or both nozzle boxes, the spacing between upper nozzles 5 and lower nozzles 6 and thus the vertical spacing can be adjusted. Actuators or the like (not shown in greater detail) can be provided for this purpose.

Figure 2:
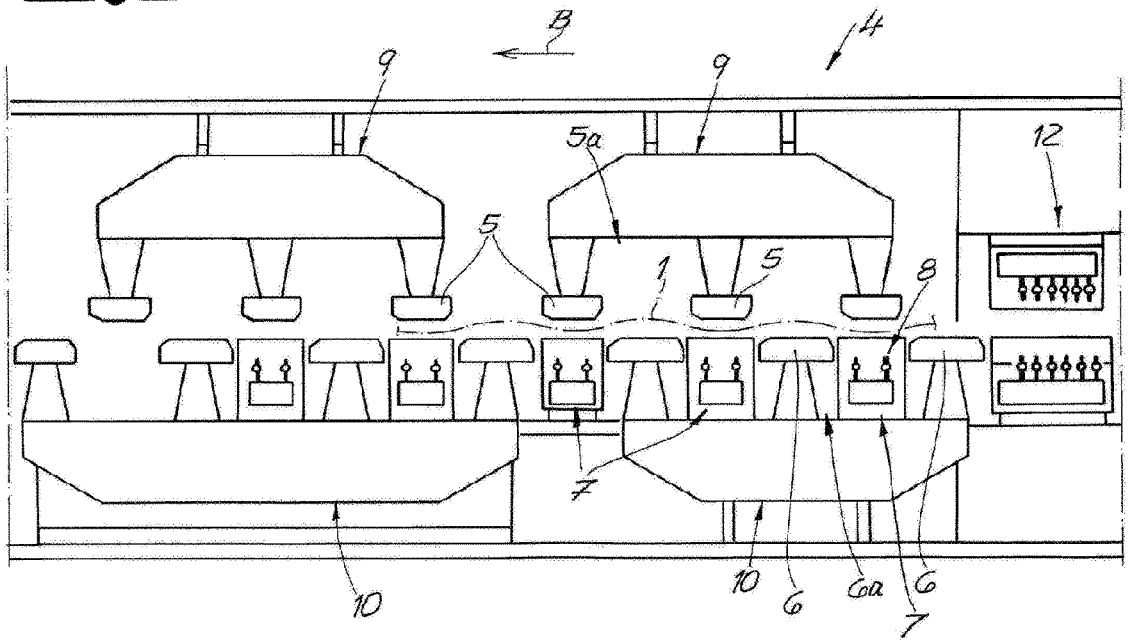
FIG. 2 is a large-scale detail from FIG. 1 in the vicinity of the continuous-flow cooling apparatus.

FIGS. 1 and 2 show the continuous-flow cooling apparatus 3 according to the invention in a first embodiment in which the upper nozzles 5 are spaced along the strip-travel direction B so as to be offset relative to the lower nozzles 6 and the metal strip 1 is caused to float in a sinusoidal or wavelike manner. In this embodiment, the water coolers 7 are thus aligned under the opposing upper nozzles 5 when viewed from the side.

Figure 3:
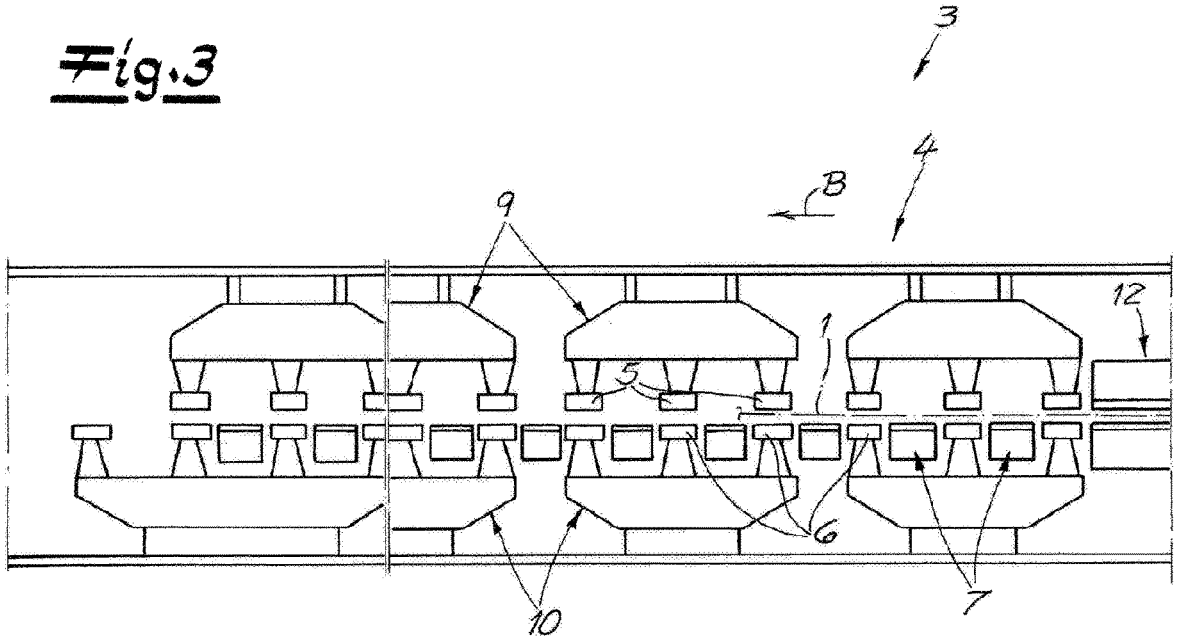
FIG. 3 shows a modified embodiment of the continuous-flow cooling apparatus according to the invention.

In contrast, FIG. 3 shows a modified embodiment of a continuous-flow cooling apparatus according to the invention in which the upper nozzles 5 on the one hand and the lower nozzles 6 on the other hand are arranged in pairs over one another, so that the strip is not caused to float in a sinusoidal or wavelike manner. In this embodiment as well, however, the water coolers 7 essential to the invention are provided in the intermediate spaces and therefore also integrated into the strip-flotation cooler 4.

Figure 4:
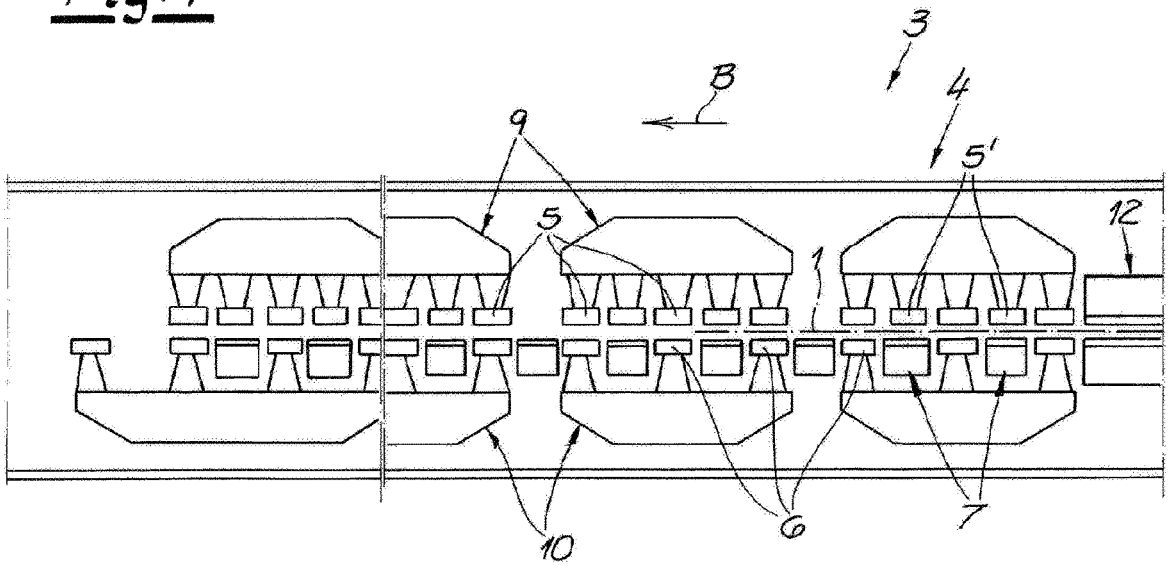
FIG. 4 shows a modification of the embodiment of FIG. 3.

FIG. 4 shows an alternative embodiment of the continuous-flow cooling apparatus according to the invention. Starting from the embodiment according to FIG. 3 with staggered upper nozzles 5' and lower nozzles 6, additional upper nozzles 5' are provided between the upper nozzles 5. These additional air nozzles 5' are thus aligned above the water coolers 7. The embodiment according to FIG. 4 thus represents a combination of the embodiments according to FIGS. 2 and 3, as it were. The air nozzles 5' aligned above the water coolers 7 prevent any water that is applied to the lower face of the strip from traveling over the edges of the strip and onto the upper face thereof.

The additional (upper) nozzles 5' can also be connected to the corresponding (upper) nozzle boxes 9 and/or integrated into them. Alternatively, however, separately embodied additional nozzles 5' can also be provided.

The strip-flotation cooler 4 according to the invention makes it possible for the metal strip 1 that was previously heat treated in the strip-flotation furnace 2 to be cooled in an optimal manner. The cooling rates can be adjusted by the combined air and water cooling with sufficient speed as to freeze in the metallurgic characteristics achieved during the heat treatment. However, excessively rapid cooling rates can be avoided, so that flaws created during cooling of the strip are kept within acceptable limits. It is especially advantageous in this regard that optimal variable adjustment options exist, so that the cooling process can be adapted optimally to the desired situation.

Very simple construction is used here overall, the air nozzles are conventional air nozzles, and the water coolers have conventional water jet nozzles so that "combined" water/air and misting nozzles as used in the prior art are dispensed with.

It can also be seen in FIG. 1 that the system for heat treating the aluminum strip also has an additional strip-flotation cooler 11 that operates in a conventional manner without water cooling and that is downstream of the strip-flotation cooler 3 in the strip-travel direction B. Therefore, according to the combined water and air cooling according to the invention, additional cooling occurs with the aid of a conventional strip-flotation cooler 11.

Moreover, it can be seen in FIG. 2 that the continuous-flow cooling apparatus downstream of the furnace 2 can also have an additional water cooler 12 upstream of the strip-flotation cooler 2 on the intake side. A so-called "hard quenching" mechanism is thus made available at the intake, and conventional, very rapid water cooling can also be optionally used as needed. The illustrated system is thus characterized by a high level of flexibility and variability.

Even though the figures show embodiments in which the continuous-flow cooling apparatus 3 according to the invention is downstream of a strip-flotation furnace 2 and thus from a temperature control unit, the invention also includes embodiments in which the continuous-flow cooling apparatus 3 is downstream of another type of processing device through which the strip travels in a heated stated or in which the strip is heated. In any case, the strip emerges from the strip treatment device in a heated state and enters the continuous-flow cooling apparatus 3.

The invention claimed is:

1. A continuous-flow cooling apparatus for cooling a metal strip, the apparatus comprising:

at least one strip-flotation cooler through which the strip passes in a strip-travel direction;

a plurality of upper air nozzles distributed in the strip-flotation cooler along the strip-travel direction above the strip;

a plurality of lower air nozzles distributed in the strip-flotation cooler along the strip-travel direction below the strip; whereby the metal strip is transported in a floating and contact-free manner between the upper air nozzles and the lower air nozzles;

a plurality of water nozzles in rows extending transversely to the strip-travel direction along the width of strip, between and separate from the air nozzles, and spaced apart in the strip-flotation cooler along the strip-travel direction below the strip;

means for applying cool air through the upper and lower air nozzles both to an upper face of the strip and a lower face of the strip for floating the metal strip in the strip-flotation cooler; and a plurality of water coolers in the strip-flotation cooler for cooling and applying water through the water nozzles to the strip in the strip-flotation cooler.

2. The apparatus defined in claim 1, wherein at least one of the water coolers is provided in each of a plurality of intermediate spaces between two respective lower air nozzles or upper air nozzles that immediately succeed each other in the strip-travel direction.

3. The apparatus defined in claim 1, wherein the strip-flotation cooler further has one or more upper nozzle boxes each having a plurality of the upper air nozzles, one or more lower nozzle boxes each having a plurality of the lower air nozzles, and water coolers in the vicinity of the lower nozzle boxes or in the vicinity of the upper nozzle boxes and/or between the nozzles of two succeeding nozzle boxes.

4. The apparatus defined in claim 1, wherein the upper air nozzles are spaced along the strip-travel direction so as to be offset relative to the lower air nozzles and to float the metal strip in a sinusoidal or wavelike manner.

5. The apparatus defined in claim 1, wherein the upper air nozzles and the lower air nozzles are aligned in respective pairs one over the other when seen from the side.

6. The apparatus defined in claim 5, further comprising, in addition to the aligned upper nozzles:

additional air nozzles between the upper air nozzles so as to be offset with respect to the lower air nozzles and thus aligned with the nozzles of the water coolers.

7. The apparatus defined in claim 1, further comprising:

at least one additional water cooler upstream of the strip-flotation cooler.

8. The apparatus defined in claim 2, wherein the metal strip is cooled between two adjacent lower nozzles or upper nozzles by the water cooler provided in the respective intermediate space by a temperature difference of no more than 100° K.

9. The apparatus defined in claim 1, wherein only water is supplied to the water nozzles and only air is supplied to the air nozzles.

* * * * *